United States Patent [19]

Homan

[11] 3,980,046

[45] Sept. 14, 1976

[54] PAPER HANGER'S PASTE APPLICATOR

[75] Inventor: John D. Homan, Cheyenne, Wyo.

[73] Assignee: The Raymond Lee Organization, Inc., New York, N.Y. ; a part interest

[22] Filed: Aug. 11, 1975

[21] Appl. No.: 603,321

[52] U.S. Cl. ..... 118/405

[51] Int. Cl.[2] ..... B05C 3/12

[58] Field of Search ..... 118/126, 123, 103, 413, 118/407, 405; 156/575, 577

[56] References Cited

UNITED STATES PATENTS

| | | | |
|---|---|---|---|
| 1,496,068 | 6/1924 | Rawley et al. | 118/122 |
| 2,062,389 | 12/1936 | Bleibler | 118/122 |
| 2,066,780 | 1/1937 | Holt | 118/126 X |
| 2,292,344 | 8/1942 | Heller et al. | 101/157 |
| 3,112,225 | 11/1963 | Harms | 118/123 X |
| 3,192,895 | 7/1965 | Galer | 118/126 |
| 3,260,577 | 7/1966 | Mayhew | 118/123 X |

*Primary Examiner*—Morris Kaplan

[57] ABSTRACT

An elongated, open-topped bucket has a trapezoidal cross-section, with the smaller base below. The bottom of the bucket has an elongated slit into which wallpaper may be introduced. A flexible lip inside the bucket guides the wallpaper up against the rear wall of the bucket and prevents paste in the bucket from leaking out the bottom. At the top of the bucket are a skimming blade and a corrugated raking blade that cooperate to remove all but the proper amount of paste from the wallpaper as the wallpaper is withdrawn from the top of the bucket. The blades are spring loaded against the wallpaper and are independently spring loaded.

2 Claims, 4 Drawing Figures

PAPER HANGER'S PASTE APPLICATOR

SUMMARY OF THE INVENTION

Conventionally, rolls of wallpaper are cut into strips of the paper length and subsequently covered with glue on one side, prior to their application to a wall.

This invention is a device that will continuously apply the proper amounts of paste to a roll of wallpaper, which can then be cut to a proper length. The savings in time to the paper hanger is substantial, especially on large jobs.

In this invention, a specially designed open-topped bucket is used. One end of a roll of wallpaper is introduced into the bottom of the bucket and guided against its rear wall. The bucket is then filled with paste and the paper is pulled out of the top of the bucket. At the top, a scraping means scrapes off all the excess paste that has adhered to the back of the paper. Because the front of the paper is always pressed against the rear wall of the bucket the front remains free of paste.

DETAILED DESCRIPTION OF THE PREFERRED EMBODIMENTS

Figure 1:
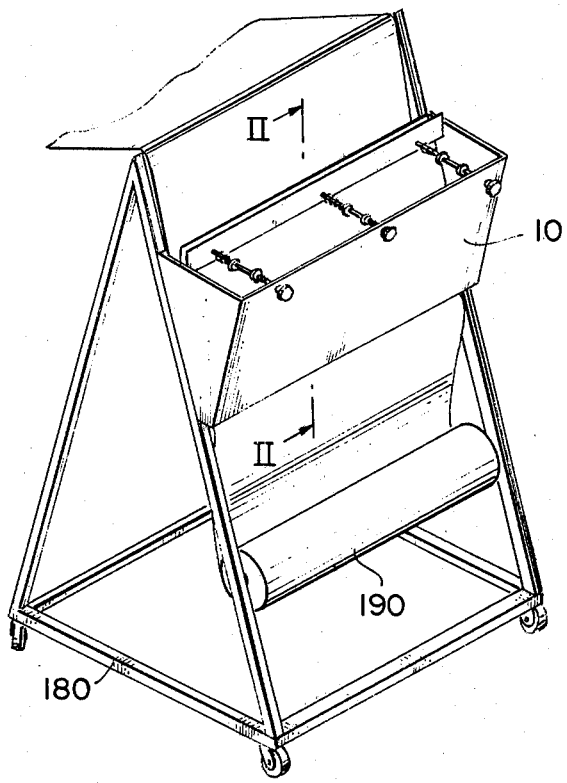
FIG. 1 shows the invention in use.
Figure 3:
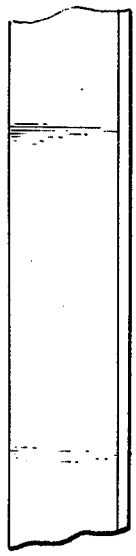
FIG. 3 is a top view of the skimming blade.
Figure 2:
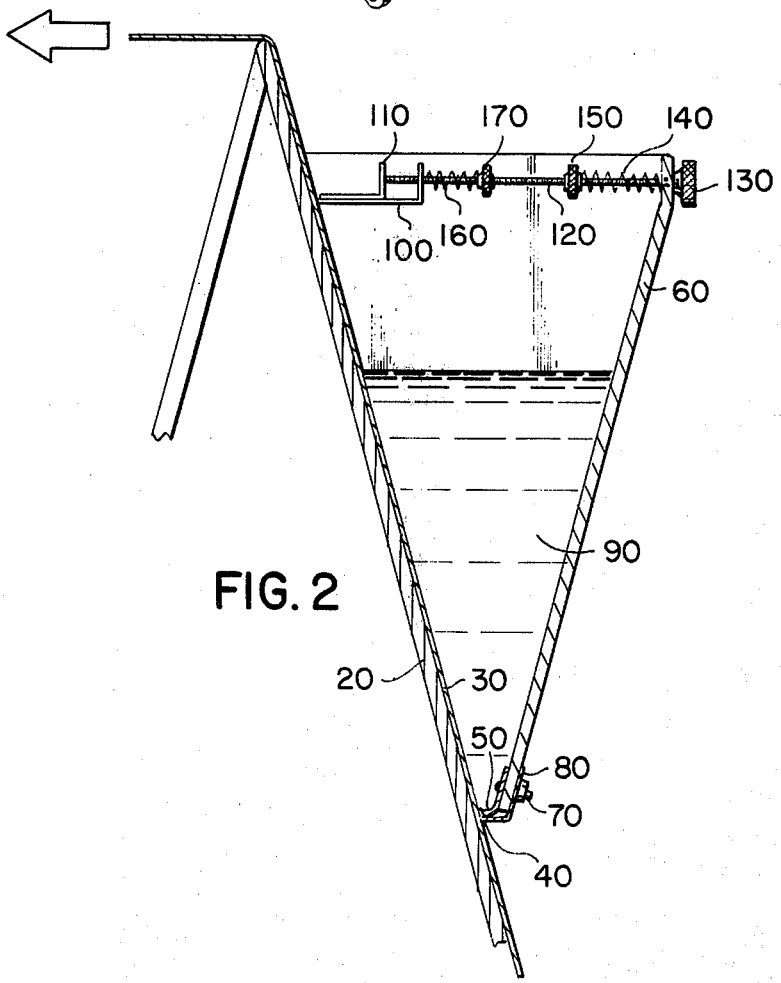
FIG. 2 is a side cross-sectional view of the invention.
Figure 4:
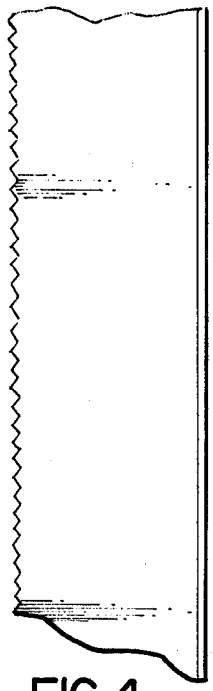
FIG. 4 is a top view of the raking blade.

An elongated open-topped bucket 10 has a trapezoidal cross-section with the smaller base on the bottom. The rear wall 20 of the bucket is elongated above and below the bucket to serve as a courier plate for wallpaper 30. The paper is fed through an elongated slit 40 in the bottom of the bucket.

Covering the slit inside the bucket is a flexible, elongated lip 50 that is attached to the front wall 60 by bolts 70, which also support an elongated, angled strip 80 that serves as the bottom of the bucket. It can be seen that the free end of the lip is pressed against the rear wall to form a concave U. Thus, the lip presses the paper against the rear wall and prevents any paste 90 in the bucket from dripping down out of the slit.

The paper can be pulled upwardly out of the top of the bucket. Since the paper is originally installed with the rear side of the paper facing forwardly before the paste is poured in, the front side of the paper is always pressed against the rear wall, and kept free of paste. The paste therefore adheres only to the rear side of the paper.

Raking blade 100 and skimming blade 110 scrape off excess paste from the rear side of the paper, in addition to keeping the top of the paper pressed against the rear wall. The portions of the blades that do the scraping are horizontal, and the edge of the raking blade is corrugated, while the edge of the skimming blade is straight.

These blades are independently spring loaded against the paper in the device. Three like threaded shafts 120 extend horizontally rearwardly from knotted knobs 130, through the front wall of the bucket.

Rigidly attached to the ends of the shafts is the vertical flange of the skimmings blade. This blade is urged rearwardly by compression springs 140, located between the front wall and adjustment nuts 150, each around its respective shaft. The vertical flange of the raking blade is forward of the corresponding flange on the skimming blade. Holes in the flange of the raking blade allow the shafts to pass through. Compression springs 160 extend rearwardly from the vertical flange of the raking blade to adjustment nuts 170 which are directly behind nuts 150. It can be seen that bringing nuts 150 forwardly on the shafts will increase the pressure exerted by the skimming blade on the paper. Moving nuts 170 in the same direction will have the opposite effect on the raking blade.

It can be seen that the blades form a nesting pair of L's, with the raking blade lowermost. Hence, as the paper is pulled up, the raking blade scrapes off most of the excess adhesive, leaving the skimming blade to even out the layer of adhesive and to reduce it to the desired thickness.

The wide device is mounted upon a triangular frame 180. A roll 190 of wallpaper is also suspended below the slit on a dowel or pipe in the frame, allowing the paper to be continuously rolled off the roll as it is needed.

I claim:

1. A device for applying paste to wallpaper, comprising:

an open-topped elongated bucket with a trapezoidal cross-section, with the large base of the trapezoidal being upwardmost and the bottom of the bucket having an elongated slit for introducing a strip of wallpaper into the bucket from the bottom;

guide means including a flexible elongated sealing lip located in the bottom of the bucket for allowing paper to be introduced into the bucket while preventing any fluid contents of the bucket from leaking downwardly out of the slit and said flexible lip maintaining the wallpaper onto the rear wall of the bucket; so that paste is applied to only one surface of said wallpaper;

scraping means located at the top of the bucket for scraping all but a predetermined amount of any contents of the bucket from said one surface of the paper;

said scraping means comprising a. a first blade at least co-extensive with the width of said surface and fixed to the end of at least one horizontally extending threaded rod passing freely through the bucket wall remote from said surface, b. resilient means mounted on said rod and biasing said rod and blade into operative contact with said surface, c. a threaded adjustment nut on said rod and cooperative with said bias means whereby to vary the bias pressure, d. a second blade at least co-extensive with the width of said surface and supported from an intermediate portion of said rod, e. second resilient means mounted on said rod and biasing said second blade into operative contact with said surface, and f. a second nut on said rod and cooperative with said second resilient means to vary the bias pressure on said second blade, whereby said blades are separately adjustable and adapted to function sequentially to first remove the major amount of excess paste and finally doctor said surface to said predetermined amount of paste.

2. The device of claim 1 wherein the first functionally operative blade is corrugated and the other blade is straight.

* * * * *